United States Patent [19]

Diethelm

[11] Patent Number: 4,815,138

[45] Date of Patent: Mar. 21, 1989

[54] IN-THE-EAR HEARING-AID WITH PIVOTABLE INNER AND OUTER SECTIONS

[76] Inventor: Beda Diethelm, Mockenwies, CH-8713 Uerikon, Switzerland

[21] Appl. No.: 61,780

[22] Filed: Jun. 15, 1987

[30] Foreign Application Priority Data

Jun. 18, 1986 [CH] Switzerland ..... 2465/86

[51] Int. Cl.[4] ..... H04R 25/02; H04R 25/00

[52] U.S. Cl. ..... 381/69.2; 381/68.4; 381/68.6; 381/69

[58] Field of Search ..... 381/69, 69.1, 69.2, 381/68.6, 69.4

[56] References Cited

U.S. PATENT DOCUMENTS 2,959,645 11/1960 Ladd ..... 381/68.6
2,971,065 2/1961 Busse ..... 381/68.6
3,852,540 12/1974 Diethelm ..... 381/68.6
4,680,799 7/1987 Henneberger ..... 381/69.2

*Primary Examiner*—Jin F. Ng
*Assistant Examiner*—Danita R. Byrd
*Attorney, Agent, or Firm*—Watson, Cole, Grindle & Watson

[57] ABSTRACT

An in-the-ear hearing aid with an inner casing section adapted to be inserted into the auditory canal and including at least the speaker and being joined to an outer casing section having at least a microphone, potentiometer, at least part of the electronics and a battery. The outer casing section is pivotable as a unit out of the inner casing section about a pivot point with parts of the pivot point between the outer and the inner casing sections being made of electrically conducting material to form an electrical connector between individual components of the hearing aid and the electrical terminals thereof in the inner and outer casing sections.

7 Claims, 3 Drawing Sheets

IN-THE-EAR HEARING-AID WITH PIVOTABLE INNER AND OUTER SECTIONS

BACKGROUND OF THE INVENTION

1. Field of the Invention

The present invention relates to an in-the-ear hearing-aid including an inner casing section intended to be inserted into the auditory canal and in which at least the earphone or speaker is received. The inner casing section is joined to an adjacently located outer casing section in the interior of which operating components such as a microphone, potentiometer, at least a part of the electronics, and the battery are received.

2. Description of the Prior Art

In the field of hearing-aids, so called in-the-ear hearing-aids have attained a special position in that they are partially carried very discretely in the outer auditory canal and partly in the ear concha.

Of these in-the-ear hearing-aids which are in increasing demand and which have been located practically completely within the ear, concha designs have prevailed in which a small as possible part is located in the ear concha proper, whereas the rest of the hearing-aid apparatus (earphone or speaker, and possibly a part of the electronics) is located in the outer auditory canal and adjusted to the canal, utilizing the available space and thereby forms an excellent seal.

Due to the limits of miniaturisation such designs often give rise to difficulties, which may arise during the assembly or when dimensioning certain adjusting or control elements, respectively.

Accordingly, the in-the-ear hearing-aids under consideration here comprise an inner casing or jacket section, which preferably can be adjusted to the available space in the outer auditory canal of the intended user and which receives at least the earphone or speaker, and possibly a part of the electronics, and an adjoining outer section which is to be located within the ear concha ahead of the auditory canal and which contains the microphone, the battery and the electronics or at least a part thereof. Furthermore, the On-Off switch and the adjusting knob of the volume control apparatus (potentiometer) should also be located in this outer section of the apparatus.

With these commonly known hearing-aids it is merely necessary to make basic adjustments of the components of the apparatus relative to the individual user's demands, whereby on the one hand such adjusting operations must possibly be repeated from time-to-time and, on the other hand, the battery has to be exchanged periodically.

The battery is located uppermost in the outer casing section and below a removable cover. When the battery is removed there exists generally an access to the control members of the components of the apparatus which are adjustable by a person skilled in this art.

This arrangement allows, however, practically no adjustments when the hearing-aid is in place within the ear. Furthermore, it often happens that the battery falls out upon opening of the cover. A further drawback is that the adjusting knob of the potentiometer can be of small dimensions, which makes a precise adjusting of the potentiometer quite difficult.

SUMMARY OF THE INVENTION

Hence, it is a general object of the present invention to provide a new design of a hearing-aid apparatus which provides the prerequisites to obviate the above stated drawbacks.

A further object is to provide an in-the-ear hearing-aid in which an outer casing section can be pivoted as a unit out of the inner casing section.

Yet a further object is to provide an in-the-ear hearing-aid in which the outer casing section may be pivoted out of the inner casing section around a pivot joint, e.g. a pivot axis or trunnion.

Due to the inventive design of the apparatus it is on the one hand possible to exchange the battery without its falling prematurely and accidentally out of its support and on the other hand the control members are also accessible when the apparatus is inserted in the ear and the battery is in place, which allows for a highly improved basic setting of the apparatus.

Furthermore, such design allows a placing of the potentiometer within the upper part of the outer casing section and a designing of the outer casing cover as a large, precisely operable adjusting knob for the potentiometer.

According to a specifically preferred embodiment of the invention, at least a part of the side wall of the outer casing section is designed to be removable or to be swung out. This provides for an access to the control member located behind the side wall.

The pivot joint between the inner and outer casing section may be releasable; it may, for example, be designated as a so-called snap-in coupling.

Furthermore, contacting parts of the pivot joint between the outer and inner casing section may consist of electrically conducting material and accordingly serve as an electrical connection between the terminals of the components of the apparatus in both casing sections.

BRIEF DESCRIPTION OF THE DRAWINGS

The present invention will be better understood, and objects other than those set forth above will become apparent, when consideration is given to the following detailed description when read in conjunction with the appended drawings, wherein.

DETAILED DESCRIPTION OF THE PREFERRED EMBODIMENTS

Figure 1:
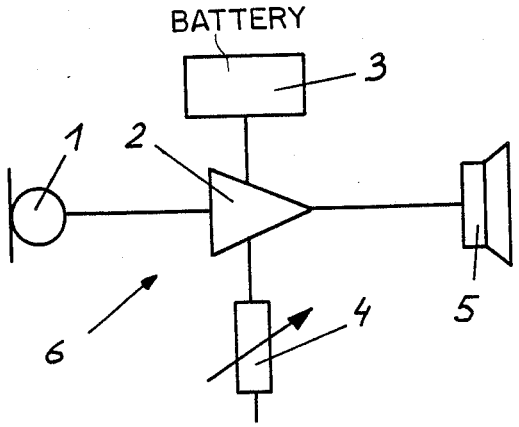
FIG. 1 illustrates a most general circuit diagram of a hearing-aid.

The circuit diagram of FIG. 1 illustrates the common design of a hearing-aid. Depending from the individual design the various miniaturized components thereof, namely the microphone 1, the amplifier or electronics 2, the batery 3, the volume control or potentiometer 4, the earphone or speaker 5, which are packaged together in a suitable casing and form the hearing-aid, specifically an in-the-ear hearing-aid.

Figure 2:
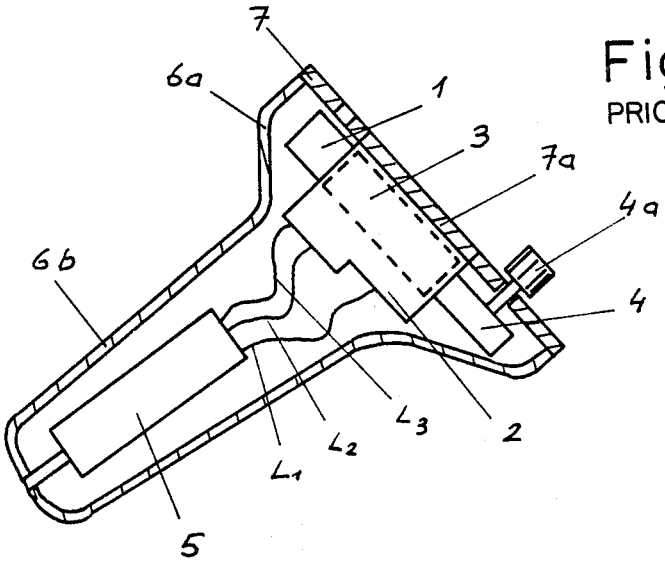
Fig. 2 PRIOR ART
FIG. 2 is a schematic section through an in-the-ear hearing-aid of a known design.

FIG. 2 illustrates on an enlarged scale a schematic section through an in-the-ear hearing-aid of a commonly known design.

The speaker 5 is located in the casing section 6b having wider portion 6a, and may be mounted prior to or after the individual adjusting of the apparatus to the auditory canal into which the apparatus is to be inserted. Thereafter, the other components such as the battery 3 and potentiometer 4 with knob 4a are mounted together with a face plate 7 through an opening 7a in the latter, whereby the difficulty of coupling the connecting leads, e.g. $L_1$, $L_2$ and $L_3$ extending from the speaker 5, to the corresponding inputs of the electronics 2 by means of soldering still exists. This is done by specifically trained personnel, however at a large expenditure of time and risk of errors.

Figure 3:
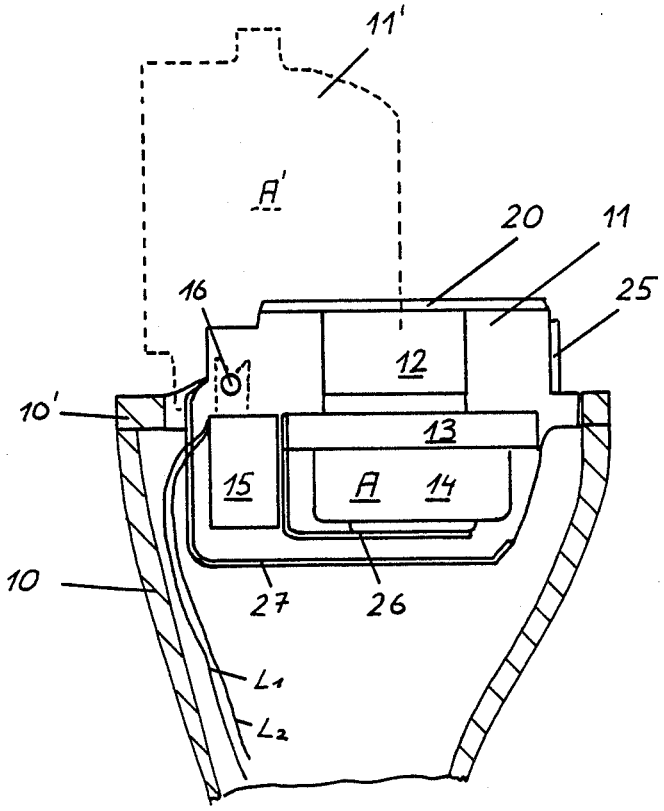
FIG. 3 is a schematic section through an in-the-ear hearing-aid designed in accordance with the present invention.

FIG. 3 illustrates schematically a hearing-aid designed in accordance with the invention. The reference numerals 10 and 10' refer to the upper part of the inner casing section and reference numeral 11 to the outer casing section, which receives in its interior space components of the apparatus such as potentiometer 12, the electronics in the form of a printed circuit 13 (or chip), the battery 14 and the microphone 15. These components are mounted within the casing section 11 permanently, removably or exchangeably, such as e.g. the battery 14. It is important, however, that the outer casing section 11 may be pivotable or may be swung, as an entire unit, i.e. together with the components of the apparatus located therein, out of the inner casing section 10, 10'. In the illustrated embodiment such is made by swinging outer casing 4 upwards around a pivot joint 16, such that this section of the apparatus can take the position illustrated with broken lines (or any intermediate position).

Figure 4:
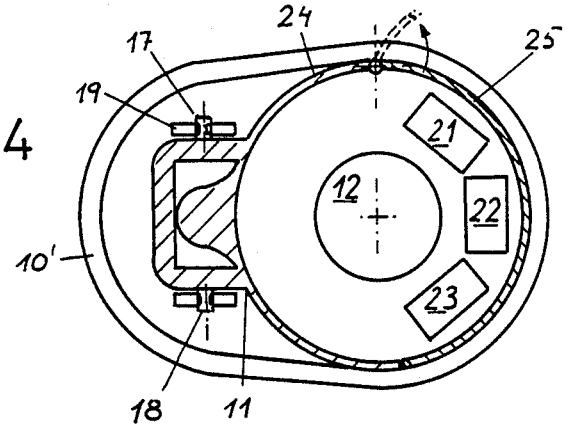
FIG. 4 is a top view of an in-the-ear hearing-aid designed in accordance with the invention.
Figure 5:
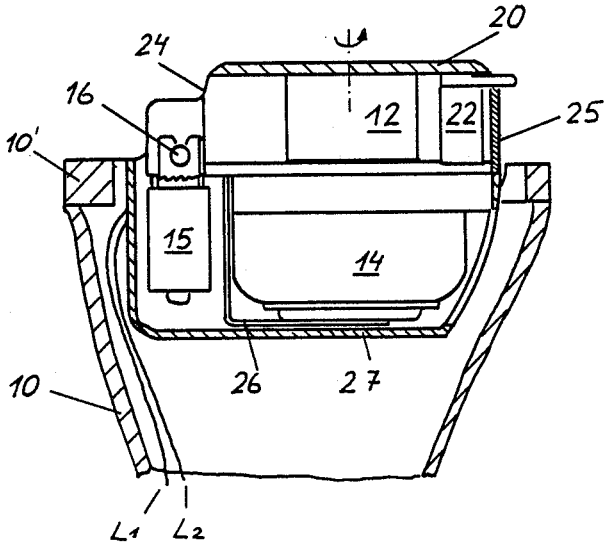
FIG. 5 is a side view, partly in section, of the hearing-aid illustrated in FIG. 4.

FIGS. 4 and 5 illustrate, also schematically, a top view and a side view, partly in section, of the inventive hearing-aid.

In this embodiment the pivot joint 16 is formed by two trunnions 17, 18 on the outer casing section 11, which trunnions are received or snapped into suitable receiving openings of a member belonging to the inner casing section 10, 10'. If this receiving member 19 as well as the trunnions 17, 18 consist of an electrically conductive material, e.g. metal, it is possible to simultaneously form an electrical connection between the inner and outer casing section 10 and 11.

This allows on the one hand an extremely simple and safe mounting possibility for assembling the two casing sections and allows on the other hand, also in case of the outer casing section being in its swung out position, maintenance of the apparatus.

Figure 6:
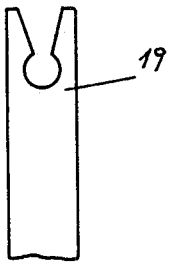
FIG. 6 is a side view of a receiving member of a pivot joint.

If the one pivot joint member 19 (having one of the trunnions 17, 18 allocated thereto) is designed as illustrated in FIG. 6, the outer casing section can be easily removed and reinserted.

The potentiometer 12 is mounted directly under the upper covering 20 within the outer casing section 11 such as illustrated in the drawing. The covering 20 can in this case be designed as a turning knob having a large area for adjusting the potentiometer which allows a highly precise adjusting thereof.

The control members, e.g. 21, 22 and 23 are also located in the upper part of the casing section 11, by means of which the acoustic specialist sets the individual basic settings.

In order to gain access to the control members a part 25 of the sidewall 24 of the outer casing section 11 is designed to be swung out. Due to this design it is possible to set the basic settings even if the apparatus is inserted into an idividual's ear.

The battery 14 is clamped between the printed circuit 13 and a contact member 26. Accordingly, if the casing section 11 is in its swung out position the battery 14 can be exchanged without any difficulties.

The bottom side of the outer casing section 11 can be covered against the inner casing section 10 by a kind of cap 27, on the one hand to provide a clean separation between the sections and on the other hand as protection as long as the two sections are not assembled. In such case the cap is provided with recesses (possibly with covers) for inserting the battery 14, microphone, etc.

While there are shown and described present preferred embodiments of the invention it shall be clearly understood that such description is for illustrative purposes only and is not to be construed in a limiting sense since many modifications and alterations within the scope of the claims may come to mind of a person skilled in the prevailing art. The scope of the invention is solely defined by the appended claims.

I claim:

1. An in-the-ear hearing-aid, comprising an inner casing section intended to be inserted into the auditory canal of an ear and in which at least the speaker is received, said inner casing section being joined to an adjacently located outer casing section in the interior of which at least a microphone, potentiometer, at least a part of the electronics and the battery are received, said outer casing section being pivotable as a unit out of said inner casing section about a pivot point, and parts of said pivot point between said outer and inner casing sections comprise an electrically conducting material to form an electrical connector between individual components of at least one of the hearing-aid and the electrical terminals thereof in the inner and outer casing sections.

2. The in-the-ear hearing-aid of claim 1, in which said potentiometer and a further control means are located in an upper part of said outer casing section and in which said outer casing comprises a cover designed as a rotary control knob for the adjusting of said potentiometer.

3. The in-the-ear hearing-aid of claim 1, in which at least a part of the side wall of said outer casing section is movable to allow access to adjustable control devices located therebehind.

4. The in-the-ear hearing-aid of claim 1, in which the pivot joint between said inner and outer casing sections is a releasable snap-in coupling.

5. The in-the-ear hearing-aid of claim 1 in which the portion of said outer casing section which projects into said inner casing section is provided with a cover.

6. The in-the-ear hearing-aid of claim 1 in which the battery is held at the lower end of said outer casing section by a contact member and is pivotable out together with said casing section.

7. The in-the-ear hearing-aid of claim 1, in which said potentiometer and a further control means are located in an upper part of said outer casing section and in which said outer casing comprises a cover designed as a rotary control knob for the adjusting of said potentiometer.

* * * * *